US007438011B2

(12) United States Patent
Kondo

(10) Patent No.: US 7,438,011 B2
(45) Date of Patent: Oct. 21, 2008

(54) APPARATUS AND METHOD FOR CUTTING SEWN MATERIAL IN SEWING MACHINE

(75) Inventor: Tetsurou Kondo, Tajimi (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/470,857

(22) Filed: Sep. 7, 2006

(65) Prior Publication Data

US 2007/0062427 A1 Mar. 22, 2007

(30) Foreign Application Priority Data

Sep. 8, 2005 (JP) ..... 2005-260589

(51) Int. Cl.
*D05B 37/06* (2006.01)
*D05B 37/00* (2006.01)

(52) U.S. Cl. ..... 112/475.04; 112/122

(58) Field of Classification Search ..... 112/122, 112/129, 130, 293, 294, 285, 300, 301, 122.3, 112/475.04, 475.06, 475.09
See application file for complete search history.

(56) References Cited

U.S. PATENT DOCUMENTS

| | | | | |
|---|---|---|---|---|
| 1,292,784 | A * | 1/1919 | Hughes, Jr. | 112/294 |
| 2,126,521 | A * | 8/1938 | Weis | 112/122.3 |
| 2,572,143 | A * | 10/1951 | Hazelton | 112/293 |
| 3,163,136 | A * | 12/1964 | Pickett | 112/130 |
| 3,747,548 | A * | 7/1973 | Brophy et al. | 112/293 |
| 4,438,714 | A * | 3/1984 | Smith et al. | 112/130 |
| 4,892,047 | A * | 1/1990 | Fieschi | 112/122 |
| 5,722,335 | A * | 3/1998 | Kamewada et al. | 112/285 |
| 6,032,598 | A * | 3/2000 | Yu | 112/294 |
| 6,189,469 | B1 * | 2/2001 | Fukumoto | 112/130 |
| 6,523,488 | B1 * | 2/2003 | Lee | 112/475.04 |

FOREIGN PATENT DOCUMENTS

| | | | |
|---|---|---|---|
| DE | 1893381 | U | 2/1964 |
| DE | 10115384 | A1 | 11/2001 |
| JP | 04-163361 | A1 | 6/1992 |
| JP | 2001-353385 | A | 12/2001 |

* cited by examiner

*Primary Examiner*—Ismael Izaguirre
(74) *Attorney, Agent, or Firm*—Rossi, Kimms & McDowell LLP

(57) ABSTRACT

A cutting apparatus has a main body with a hook section, a fixed blade fixed to a predetermined position of the main body, a cutting blade that cuts a sewing material by moving toward the fixed blade, and a drive device that moves the main body between a predetermined retracted position that does not interfere with the sewing operation and a predetermined cutting position for cutting the sewing material. During sewing of the sewing material, the main body is held at the retracted position. To cut the sewing material, the drive device moves the main body from the retracted position to the cutting position, where the hook section hooks the sewing material, and the cutting blade moves toward the fixed blade in response to driving operation of the drive device. The cutting apparatus is disposed a predetermined distance away from the sewing position.

13 Claims, 8 Drawing Sheets

APPARATUS AND METHOD FOR CUTTING SEWN MATERIAL IN SEWING MACHINE

BACKGROUND OF THE INVENTION

1. Field of the Invention

The present invention generally relates to sewing machines of a type which sews an elongated sewn material, such as a tape or cord, to an object of sewing (typically, fabric) through lock stitching. More particularly, the present invention relates to an apparatus and method for cutting an elongated sewn material, for example, at the end of sewing.

2. Description of the Related Art

Conventionally, there have been known sewing machines of a type which includes a vertically driven needle bar, a sewing needle fixed to a lower end portion of the needle bar, a rotary member mounted concentrically with the needle bar and freely rotatable about the axis, and a guide fixed to the rotary member, for guiding an elongated sewn material (e.g., string-shaped embroidering member, such as a tape or cord) to a sewing position of the sewing needle. The sewing machines of the type operate to sew the string material to a fabric through lock stitching, by the rotation of the rotary member being appropriately controlled in accordance with a moving direction of a fabric based on embroidery data and by the orientation of the guide being appropriately varied to optimize the direction in which the string material is guided to the sewing position of the sewing needle. One example of such sewing machines is known from Japanese Patent Application Laid-open Publication (Kokai) No. H04-163361. The No. H04-163361 publication discloses a cutting apparatus which cuts a string material in a sewing machine of the above-mentioned type. Brief description will now be given of the cutting apparatus disclosed in the No. H04-163361 publication. This cutting apparatus is comprised of a support member which is moved to a retracted position which does not interfere with sewing operation and an advanced position near the sewing position of the sewing needle, and a hook member which is provided on the support member and movable forward and backward so as to hook the string material thereon. The support member always lies at the retracted position during sewing, and when it is necessary to cut the string material having been used for sewing, for example, at the end of sewing, the support member can be moved to the advanced position. When the support member lies at the advanced position, the hook member is moved forward and backward to hook thereon the string material at the sewing position and draw the string material to the support member, and then the string material is cut. In this case, an upper thread as well as the string material is cut at the same time.

In the conventionally-known cutting apparatuses like the one as disclosed in the No. H04-163361 publication, a drive source for moving the support member to the retracted position and the advanced position, and a drive source for moving the hook member forward and backward are separately provided as individual dedicated drive sources. However, there has been the problem that, since such a cutting apparatus driven by a plurality of drive sources is expensive and large in size, the sewing machine is also expensive and making the sewing machine compact is difficult. There have also been known cutting apparatuses of a type which is provided with the third drive source for driving a cutting blade which actually cuts a string material, but the cutting apparatuses of this type would suffer from the inconveniences that the cost and size are further increased.

Further, in sewing a string material (elongated sewn material), it is necessary to pull a certain amount of the string material out of the guide and to leave a certain amount of the upper thread at a tip of the sewing needle so that the string material can be reliably sewn onto a fabric at the beginning of sewing. However, in the conventionally-known cutting apparatuses like the one disclosed in the No. H04-163361 publication, after the support member is moved from the retracted position to the advanced position near the sewing position of the sewing needle, the string material at the sewing position as well as the upper thread is drawn to the support member and then cut. Thus, after the string material and the upper thread are cut, only a slight amount of the string material is out of the guide, and only a slight amount of the upper thread remains at the tip of the sewing needle. In such a case, in performing sewing again after cutting the string material and the upper thread, it is necessary to pull out the slight amount of the string material out of the guide and the slight amount of the upper thread remaining at the tip of the sewing needle need by certain amounts. Particularly in multi-head sewing machines of a type which is provided with a plurality of machine heads, the string material and the upper thread must be pulled out in each machine head, which is very troublesome.

SUMMARY OF THE INVENTION

It is an object of the present invention to provide a cutting apparatus which can be caused to move from a retracted position to a cutting position and caused to hook a string material (elongated sewn material) by a single drive source.

It is another object of the present invention to provide a cutting apparatus whose cutting blade is driven by the drive source which drives the cutting apparatus from the retracted position to the cutting position.

It is still another object of the present invention to provide a cutting apparatus and method which can pull a greater amount of string material (elongated sewn material) out of a guide unit after the string material is cut, as compared with the conventional art.

The present invention provides a cutting apparatus for cutting an elongated sewn material when sewing of the sewn material is completed in a sewing machine including a guide unit that guides the sewn material to a sewing position of a sewing needle, the sewing machine sewing the guided sewn material onto an object of sewing, the cutting apparatus comprising. The cutting apparatus is comprised of: a main body including a hook section for hooking thereon the sewn material; a fixed blade fixed to a predetermined position of the main body; a cutting blade that cuts the sewn material by moving toward the fixed blade; and a drive device that moves the main body between a predetermined retracted position that does not interfere with sewing operation and a predetermined cutting position for cutting the sewn material. In sewing the sewn material, the main body is held at the retracted position, and in cutting the sewn material, the main body is caused to move from the retracted position to the cutting position by the drive device. The hook section is provided in the main body and at such a location as to hook thereon the sewn material as the main body moves to the cutting position. The cutting blade cuts the sewn material in a state in which the hook section hooks thereon the sewn material.

With this arrangement, the same drive device can drive the main body to move from the retracted position to the cutting position and cause the sewn material to be hooked on the hook section. Thus, the cutting apparatus has to be provided with only one drive source, and therefore, the cutting apparatus can be reduced in cost and size.

Preferably, the cutting blade is configured to move in response to movement of the main body and to move toward the fixed blade in cutting the sewn material. Also preferably, in cutting the sewn material, the cutting blade moves toward the fixed blade by being driven by the drive device.

Still preferably, the cutting apparatus is further comprised of: a connecting mechanism that connects the drive device and the cutting blade to each other; a first regulating member that regulates movement of the main body, having moved toward the cutting position by being driven by the drive device, at a first predetermined position so as to define the cutting position; and a second regulating member that regulates movement of the connecting mechanism having been moved in response to driving operation of the drive device, wherein the second predetermined position is a position which the connecting mechanism reaches when the drive device is driven after the movement of the main body is regulated at the first predetermined position, and after the movement of the main body is regulated at the first predetermined position and before movement of the connecting mechanism is regulated at the second predetermined position, the cutting blade is caused to move toward the fixed blade of the main body by being further driven by the drive device and cut the sewn material.

With this arrangement, the single drive source can drive the main body to move from the retracted position to the cutting position, cause the sewn material to be hooked on the hook section, and drive the cutting blade to move in response to driving operation of the drive device. Thus, the cutting apparatus can be further reduced in cost and size.

In a preferred form of the present invention, the cutting apparatus is disposed a predetermined distance away from the sewing position of the sewing needle. In this case, control is performed such that, when sewing of the sewn material is completed, the object of sewing onto which the sewn material has been sewn is moved the predetermined distance toward the location at which the cutting apparatus is disposed, and thereafter, the drive device is driven to cause the main body to move to the cutting position and cut the sewn material.

By thus moving the object of sewing (fabric) with the sewn material sewn thereon to the position which is the predetermined distance away from the sewing position of the sewing needle, an excess amount of the sewn material can be pulled out of the guide unit. It is therefore possible to pull a sufficient amount of the sewn material out of the guide unit even after the sewing material is cut.

Further, the present invention provides a cutting method for cutting an elongated sewn material when sewing of the sewn material is completed in a sewing machine including a guide unit that guides the sewn material to a sewing position of a sewing needle, the sewing machine sewing the guided sewn material onto an object of sewing. The cutting method is comprised of the steps of disposing a cutting apparatus for cutting the sewn material a predetermined distance away from a sewing position of the sewing needle; when sewing of the sewn material is completed, moving an object of sewing onto which the sewn material has been sewn the predetermined distance toward the position at which the cutting apparatus is disposed; and causing the cutting apparatus to cut the sewn material.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
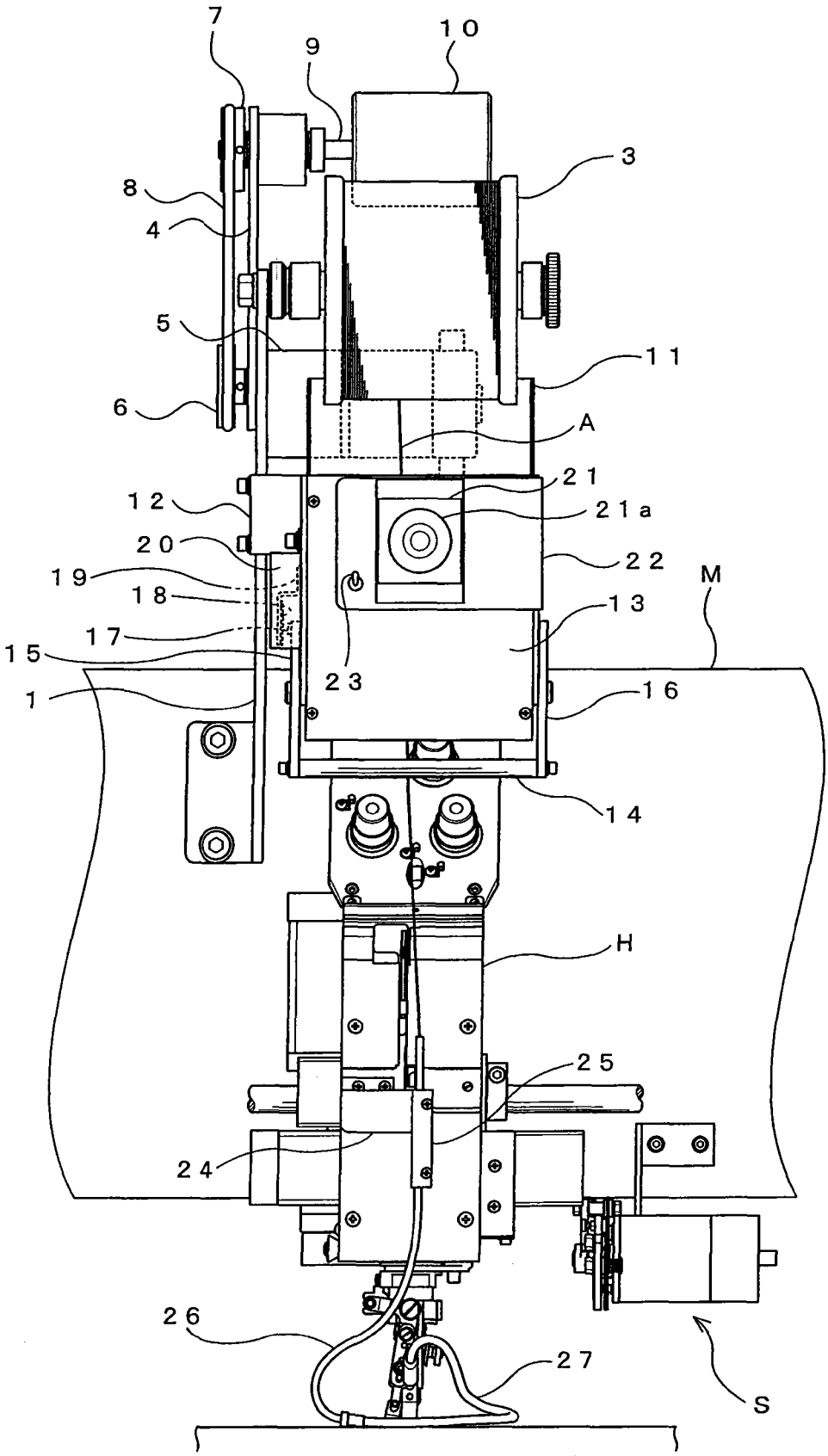
FIG. 1 is a front view showing an external appearance of part of an embroidering sewing machine in accordance with an embodiment of the present invention.
Figure 2:
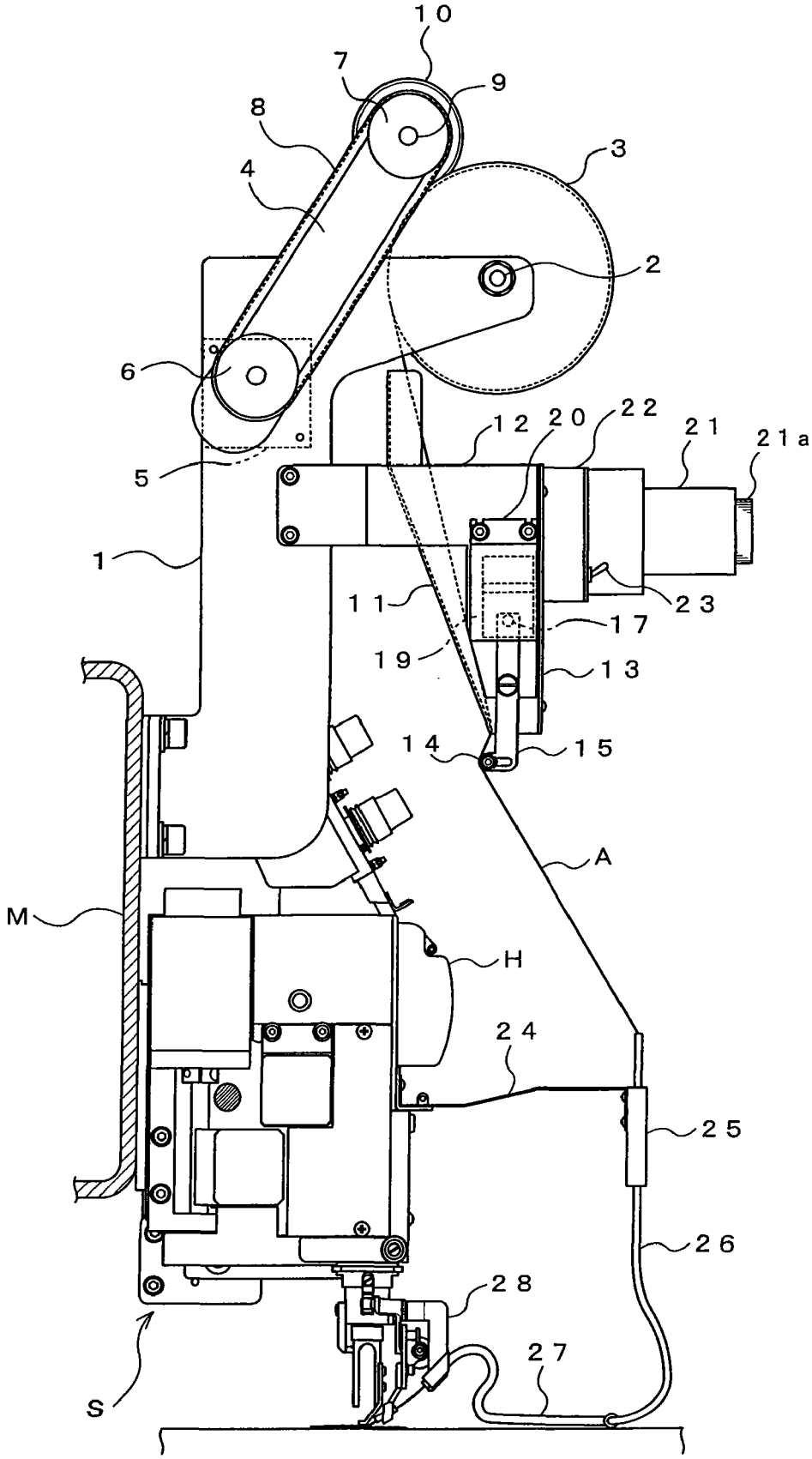
FIG. 2 is a left side view of the embroidering sewing machine taken from a left side of the machine shown in FIG. 1.

FIG. 1 is a front view showing an external appearance of part of an embroidering sewing machine in accordance with an embodiment of the present invention. FIG. 2 is a left side view of the embroidering sewing machine taken from a left side of the machine shown in FIG. 1. Construction of the embroidering sewing machine will be described below with primary reference to FIGS. 1 to 2. Whereas a plurality of machine heads H are disposed at predetermined intervals on a front surface (i.e., a surface closer to a reader of FIG. 1 and a right side surface in FIG. 2) of a machine frame M of the actual embroidering sewing machine, only one of the machine heads H is shown in the figures to facilitate understanding of the following description.

In addition to such machine heads H, a support member 1 is fixed, via bolts or the like, to a predetermined position of the front surface of the machine frame M. As seen mainly from FIG. 2, opposite end portions of the support member 1 which are fixed to the front surface of the machine frame M are formed into a shape having an arm section extending in a horizontal direction toward the front surface of the embroidering sewing machine (right side as viewed in FIG. 2). Further, a bobbin shaft 2 is fixed to a distal end of the arm section. Bobbin 3 having a string material A (elongated sewn material), such as a tape or cord, wound thereon is detachably attached to the bobbin shaft 2 in such a manner that the bobbin 3 can be prevented from falling and can freely rotate.

Support plate 4 is fixed to the support member 1 in such a manner that it projects toward a position above the bobbin 3. Proximal end portion of the support plate 4 is rotatably supported by a motor shaft of a drive motor 5 fixed to the support member 1. Driving pulley 6 is fixed to the motor shaft of the drive motor 5 fixed to the support member 1. The driving pulley 6 and the support member 1 inhibit the movement of the support plate 4 along the axis of the drive motor 5. Driven pulley 7 is rotatably provided on a distal end portion of the support plate 4, and a round belt 8 is wound on and operatively connect the driven pulley 7 and driving pulley 6. The driven pulley 7 is fixed to one end of a shaft 9 rotatably supported on a distal end portion of the support plate 4, and a rotary pulley 10 is fixed to the other end of the shaft 9. The rotary pulley 10 is held in abutment against the string material A wound on the bobbin 3. Thus, as the driving pulley 6 rotates by being driven by the drive motor 5, the rotation of the driving pulley 6 is transmitted via the round belt 8 to the driven pulley 7, which rotates the rotary pulley 10 fixed to the same shaft 9 as the driven pulley 7. Namely, the rotational force produced from the drive motor 5 is sequentially transmitted to the driving pulley 6, round belt 8, driven pulley 7, shaft 9 and rotary pulley 10 in response to driving operation of the drive motor 5, so that, ultimately, the bobbin 3 can be rotated by the thus-transmitted rotational force.

Since the support plate 4 is pivotally supported on the motor shaft of the drive motor 5, the distal end portion of the support plate 4 is caused to pivot in a clockwise direction (downward as viewed in FIG. 2) under its own weight at that part as the amount of the string material A wound on the bobbin 3 decreases with consumption of the string material A in accordance with a progression of the sewing operation. Thus, even if the amount of the string material A wound on the bobbin 3 decreases, the rotary pulley 10 and the string material A wound on the bobbin 3 are kept in abutment against each other, so that the bobbin 3 can be reliably rotated. It should be noted that a biasing means for biasing the support plate 4 in a clockwise direction (downward as viewed in FIG. 2) may be provided on the support plate 4 so that the rotary pulley 10 can be more reliably abutted against the string material A wound on the bobbin 3. Also, a non-slip member such as rubber may be provided on a surface of the rotary pulley 10 so that the bobbin 3 can be reliably rotated in accordance with rotation of the rotary pulley 10.

Guide member 11 for guiding the string material paid out from the bobbin 3 downward is provided below the bobbin 3. The guide member 11 is fixed to a guide base 12 which is fixed, via bolts or the like, to a part of the support member 1 below the arm section thereof to which the bobbin shaft 2 is fixed and extending horizontally toward the front surface of the embroidering sewing machine (right side as viewed in FIG. 2). Cover 13 can be fixedly mounted on a front surface of the guide member 11, and the string material A is guided downward via a space formed by the guide member 11 and the cover 13. Rod 14 is provided below the guide member 11, and both ends of the rod 14 are fixed to respective lower end portions of a pair of pivot arms 15 and 16 which are pivotally supported at respective predetermined right and left position sandwiching in the machine head H therebetween. The pivot arm 15 disposed on the left side as viewed in FIG. 1 is pivotally supported at its substantially middle portion by the guide base 12, and the pivot arm 16 disposed on the right side as viewed in FIG. 1 is pivotally supported at its substantially middle portion by the guide member 11. The pivot arms 15 and 16 are caused to pivot, by tension applied to or acting on the string material A as the string material A is sewn, about the substantially central part thereof supported by the guide base 12 or the guide member 11 as the rod 14 is moved toward the front surface of the embroidering sewing machine (right side as viewed in FIG. 2). Magnet 17 is fixed to an upper end portion of the pivot arm 15 disposed on the left side. In the guide base 12, a bracket 19 is fixed in such a manner that a surface of part of the bracket 19 faces the magnet 17 fixed to the pivot arm 15, and a magnetic sensor 18 can be attached to the surface of the part of the bracket 19. Thus, the magnetic sensor 18 can be disposed at a position opposed to the magnet 17 fixed to the pivot arm 15, and hence the magnetic sensor 18 and the magnet 17 disposed in opposed relation to each other can detect the pivotal movement of the pivot arm 15 (and the pivot arm 16 which operate in the same manner). Cover 20 is attached to the bracket 19.

Also, as shown in FIGS. 1 or 2, a bracket 22 is fixed to the guide member 11 in such a manner that it covers part of the cover 13, and the bracket 22 is provided with a timer 21 and a switch 23 for controlling the driving operation of the drive motor 5. The timer 21 is a well-known analog timer and intended to provide predetermined control in accordance with the time set by a dial operating element 21*a* provided on a distal end portion of the timer 21. In the present embodiment, control is performed such that the timer 21 starts measuring time at a time point when the magnetic sensor 18 detects the pivotal movement of the pivot arms 15 and 16, and the driving motor 5 is caused to operate for the time set by the dial operating element 21*a*. The switch 23 is intended to make a setting as to whether to interrupt a drive signal from the timer 21 to the drive motor 5 so as to inhibit the drive motor 5 from operating even if the pivot arms 15 and 16 pivot when the string material A is placed so as to be sewn, for example, before the start of sewing.

Holder 25 is fixed via a bracket 29 to a front surface (i.e., a surface closer to the reader of FIG. 1 and a right side surface in FIG. 2) of the machine head H, and a flexible first tube 26 for passing therethrough the string material A is fixed to the holder 25. Further, a second tube (e.g., spiral tube) 27, more flexible than the first tube 26, is connected to the distal end of the first tube 26. The second tube 27 is fixed at its distal end to a holder arm 28 that is in turn fixed to a later-described rotary bush 37 (see FIG. 3). With this arrangement, the string material A guided downward by the guide member 11 can always be guided in a state of abutment against a back side (left side as viewed in FIG. 2) of the rod 14, through the two tubes 26 and 27, to a right position (sewing position, i.e., drop position of the sewing needle 29 or position of sewing by the sewing needle 29) corresponding to the tip of the sewing needle 29 (see FIG. 3) via a later-described guide 46 (see FIG. 3).

Figure 3:
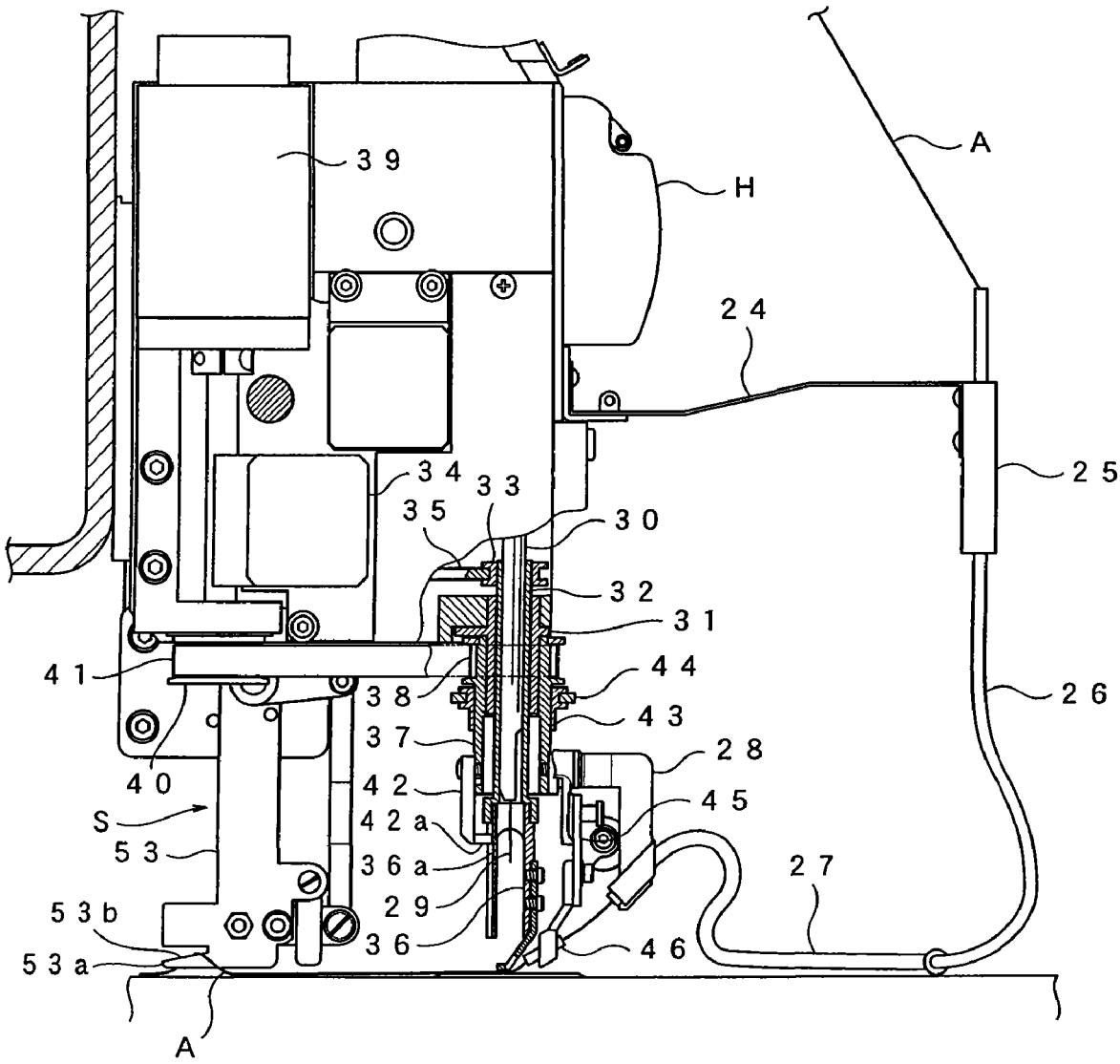
FIG. 3 is a partly-sectional side view of a machine head.

Now, the construction of the machine head H will be described in detail with primary reference to FIG. 3. FIG. 3 is a partly-sectional side view of the machine head H. The machine head H is a conventional machine head, and a needle bar 30 with the sewing needle 29 fixed to its lower end is vertically-movably provided on the machine head H. Guide pipe 31 is fixed to a bottom plate of the machine head H, and a fabric-holder driving pipe 32 is provided within the guide pipe 31 in such a manner that it is vertically movable along and pivotable about the axis of the guide pipe 31. The needle bar 30 is passed through the fabric-holder driving pipe 32 for vertical movement. Engaging ring 33 is fixed to and along the outer periphery of an upper end portion of the fabric-holder driving pipe 32, and a stroke arm 35, vertically movable via a motor 34, is held in engagement with the engaging ring 33. Fabric holder 36 is fixed to a lower end portion of the fabric-holder driving pipe 32. The rotary bush 37 is provided along the outer periphery of the guide pipe 31 in such a manner that it is rotatable about the axis of the needle bar 30. Timing pulley section 38 is formed on the outer periphery of an upper end portion of the rotary bush 37. The timing pulley section 38 is operatively connected, via a timing belt 41, with a driving pulley 40 that is rotatable via a motor 39. With such arrangements, the rotary bush 37 can be rotated by activation of the motor 39.

Engagement member 42 is fixed to the rotary bush 37 and extends downward therefrom, and the engaging member 42 has, at its distal end, an engagement section 42*a* engaged in a groove 36*a* formed vertically in the outer periphery of the fabric holder 36. Thus, the fabric holder 36 is vertically movable along and rotatable about the axis of the needle bar 30 together with the rotary bush 37. Interlocking member 43 is provided along the outer periphery of the rotary bush 37 in such a manner that it is vertically movable and rotatable together with the rotary bush 37. Ring 44 vertically movable via a not-shown drive source is provided in a groove formed in the outer periphery of the interlocking member 43. Further, a guide lever 45 (e.g. zigzag swing lever) is rotatably provided on the outer peripheral surface of the rotary bush 37. The guide lever 45 is connected with the interlocking member 43 so as to pivot in response to the vertical movement of the interlocking member 43, and a pipe-shaped guide 46 for guiding the string material A to the sewing position of the sewing needle 28 is fixed to the lower end of the guide lever 45.

Figure 4:
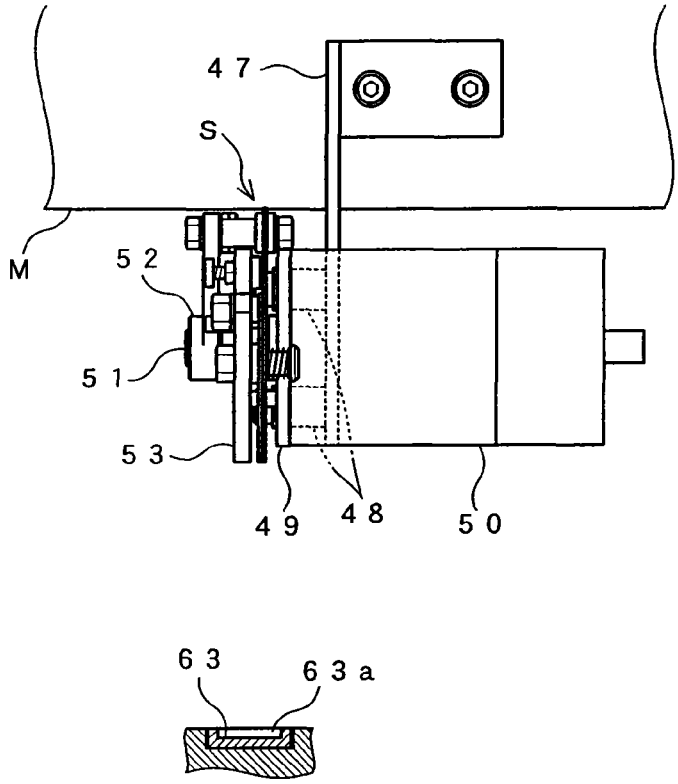
FIG. 4 is a front view of a cutting apparatus lying at a retracted position.
Figure 5:
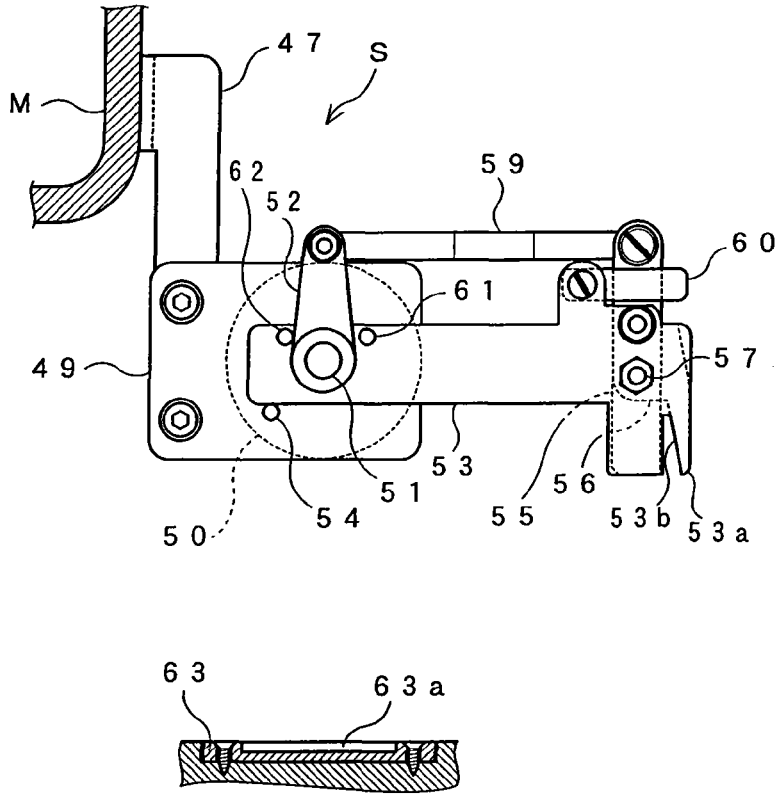
FIG. 5 is a left side view of the cutting apparatus taken from a left side of the apparatus shown in FIG. 4.
Figure 6:
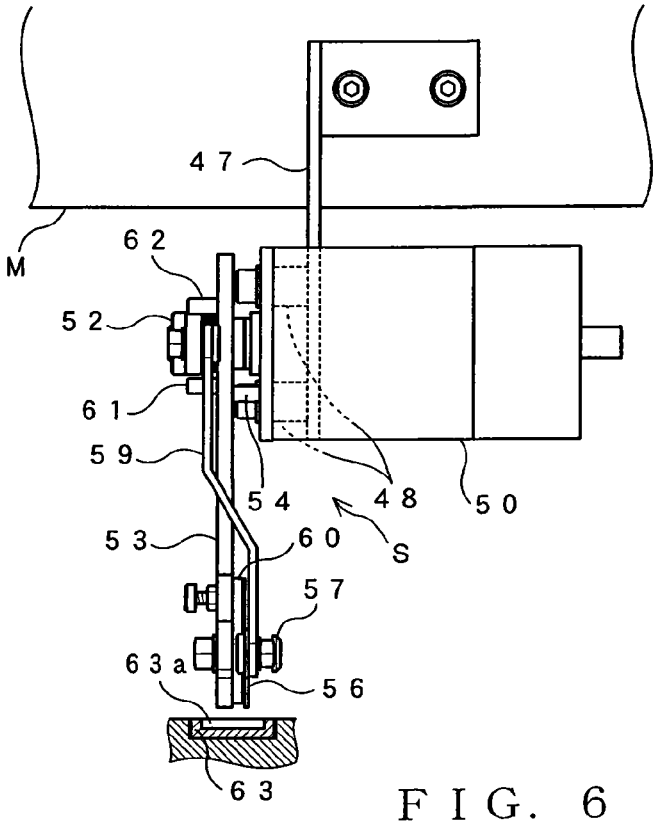
FIG. 6 is a front view of the cutting apparatus lying at a cutting position.
Figure 7:
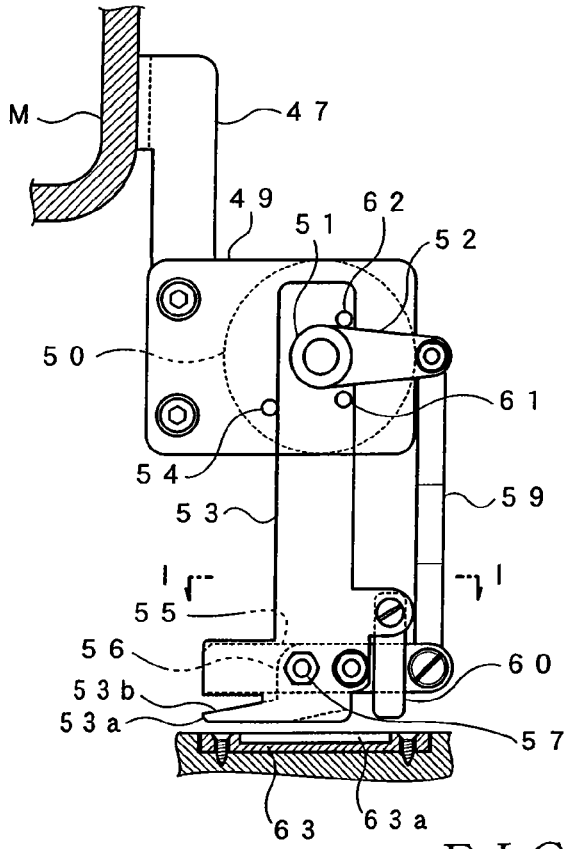
FIG. 7 is a left side view of the cutting apparatus taken from a left side of the apparatus shown in FIG. 6.

Referring next to FIGS. 4 to 9, a description will be given of a cutting apparatus S for cutting the string material A in the embroidering sewing machine constructed as described above. FIG. 4 is a front view of a cutting apparatus lying at a retracted position. FIG. 5 is a left side view of the cutting apparatus taken from a left side of the apparatus shown in FIG. 4. FIG. 6 is a front view of the cutting apparatus lying at a cutting position. FIG. 7 is a left side view of the cutting apparatus taken from a left side of the apparatus shown in FIG. 6. In the machine frame M, the cutting apparatus S is disposed at a predetermined position on the right side of the machine head H appearing in FIG. 1. Here, the retracted position is a position which does not interfere with sewing of the string material A, and the cutting position is a position at which the string material A used for sewing is cut.

As seen from FIGS. 4 to 9, a bracket 47 is fixed to the machine frame M via bolts or the like, and a base member 49 is fixed to the bracket 47 via a spacer 48. Pneumatically-driven rotary actuator 50 is fixed to the base member 49 in such a manner that a rotary shaft 51 of the actuator 50 passes through the base member 49. Drive lever 52 is fixed to the rotary shaft 51, and also, a flat-shaped knife base 53 is pivotally supported on the drive lever 52. Torsion spring, not shown, is provided between the driver lever 52 and the knife base 53. By inserting opposite end portions of the torsion spring into holes, not shown, formed in the drive lever 52 and the knife base 53, for fitting therein predetermined ends of the torsion spring, the torsion spring and the drive lever 52 and the knife base 53 are connected to each other. Thus, when the drive lever 52 is caused to pivot by activation of the rotary actuator 50, the knife base 53 is rotated at the same time via the torsion spring. The knife base 53 normally lies at the retracted position which does not interfere with sewing of the string material A as shown in FIGS. 4 and 5, and when it is necessary to cut the string material A, the knife base 53 is caused to pivot to the cutting position for cutting the string material A as shown in FIGS. 6 and 7. Stopper 54 against which the knife base 53 having pivoted to the retracted position or cutting position abuts is provided at a predetermined position on the base member 49 so that the knife base 53 can be positioned at each of these positions. On the other hand, a pair of stoppers 61 and 62 which limit the pivotal movement range of the drive lever 52 is provided on the knife base 53. Further, a hook section 53*a* is formed on a distal end portion of the knife base 53, and a cutting concave section 53*b* tapered from the hook section 53*a* is formed like a slit. Accordingly, a plate 63 having a groove section 63*a* into which the hook section 53*a* is fitted when the knife base 53 is caused to pivot is fixedly mounted on a well-known machine table below the cutting apparatus S.

Figure 8:
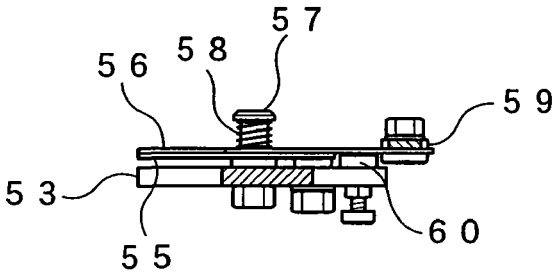
FIG. 8 is a sectional view of the cutting apparatus taken along line I-I in FIG. 7.
Figure 9:
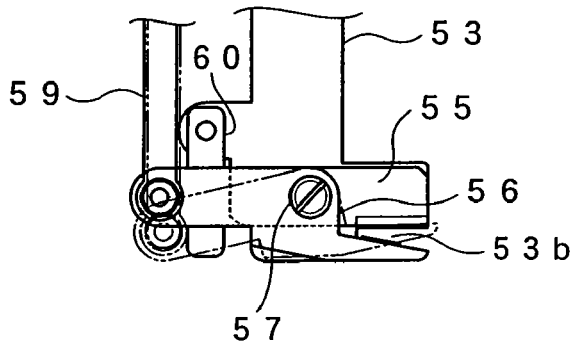
FIG. 9 is a right side view of a lower part of the cutting apparatus taken from a right side of the apparatus shown in FIG. 8.

FIG. 8 is a sectional view of the cutting apparatus S taken along line I-I in FIG. 7. FIG. 9 is a right side view of a lower part of the cutting apparatus taken from a right side of the apparatus shown in FIG. 8. As seen from FIGS. 8 and 9, a fixed knife 55 is fixed to and a pivotable knife 56 is pivotally supported on the fixed base 53. The pivotable knife 56 is supported at its substantially middle portion by a support pin 57 in such a manner that it is pivotable and movable along the axis of the support pin 57. Coil spring 58 which biases the pivotable knife 56 in such a direction as to come into contact with the fixed knife 55 is provided on the support pin 57. One end of the pivotable knife 56 is connected to a distal end portion of the drive lever 52 via a connecting plate 59. The pivotable knife 56 has a cutting edge thereof normally lying at such a pivot position flush as to be flush with a lower end portion of the cutting concave section 53*b* of the knife base 53. The fixed knife 55 has a cutting edge thereof provided at such a pivot position as to be flush with an upper end portion of the cutting concave section 53*b* of the knife base 53. When the knife base 53 is caused to pivot to the cutting position, the fixed knife 55 and the pivotable knife 56 cut the string material A having been hooked on the hook section 53*a* of the knife base 53 and guided into the cutting concave section 53*b*. Guide member 60 is disposed in contact with a side of the pivotable knife 56. The guide member 60 biases the cutting edge of the pivotable knife 56 toward the fixed knife 55 and thereby cuts the string material A in a reliable manner.

The following paragraphs describe how the embroidering sewing machine constructed as described above operates to sew the string material A to a not-shown fabric, not shown, by lock stitching.

First, the string material A wound on the bobbin 3 is paid out and guided to the sewing position of the sewing needle 29 via the guide member 11, back side of the rod 14, first tube 26, second tube 27, and guide 46, as explained above. Then, control is performed, on the basis of embroidery data, such that the not-shown fabric is moved in X- and Y-axis directions and the needle bar 30 is vertically driven to perform the well-known lock stitching by the sewing needle 29 in conjunction with a not-shown rotary hook. During that time, the fabric holder 36 is driven vertically, in predetermined timing relative to the vertical movement of the needle bar 30, to perform the fabric holding function, as well known in the art. Further, the ring 44 is driven vertically, in predetermined timing relative to the vertical movement of the needle bar 30, in response to which the interlocking member 43 is vertically moved to cause the guide lever 45 to pivot. As a consequence, the string material A, having been guided to the sewing position of the sewing needle 29 by the guide 46 fixed to the lower end of the guide lever 45, is swung to the left and right of the sewing position, for example, per vertical reciprocation (i.e., per stitch) of the needle bar 30. In this way, the string material A can be sequentially sewn onto the fabric by so-called "zig-zag switching".

During that time, the rotary bush 37 is rotated by the motor 39 via the driving pulley 40, timing belt 41, and timing pulley 38, in response to which the guide 46 is controlled to be positioned forward in a direction of relative movement of the machine head H based on the movement of the fabric. In this way, the string material A can be appropriately guided to the sewing position of the sewing needle 29. If the rotary bush 37 is rotated 360 degrees or more, the second tube 27 might get undesirably entwined around the machine head H; thus, it is necessary that the embroidery data be made so as not to rotate the rotary bush 37 360 degrees or more.

As the string material A is sequentially sewn onto the fabric in the above-described manner, the rod 14 is pulled forward by the string material A, and in accordance with the movement of the rod 14, the pivot arms 15 and 16 are caused to pivot. When the pivot arm 15 is caused to pivot, the magnetic sensor 18 detects this pivotal movement, and the drive motor 5 is operated to rotate the bobbin 3 for a period of time set by the timer 21 based on the detected pivotal movement, so that the string material A is paid out from the bobbin 3. After that, when the pivot arms 15 and 16 have pivoted again as the string material A is sequentially sewn onto the fabric, the same operation as the above described one is performed to cause the bobbin 3 to rotate to pay out the string material A. Thus, in sewing the string material A onto the fabric, by repeating the rotation and termination of the rotation of the bobbin 3 in accordance with the tension of the string material A, it is possible to smoothly and appropriately pay out the string material A to the sewing position of the sewing needle 29.

Figure 10:
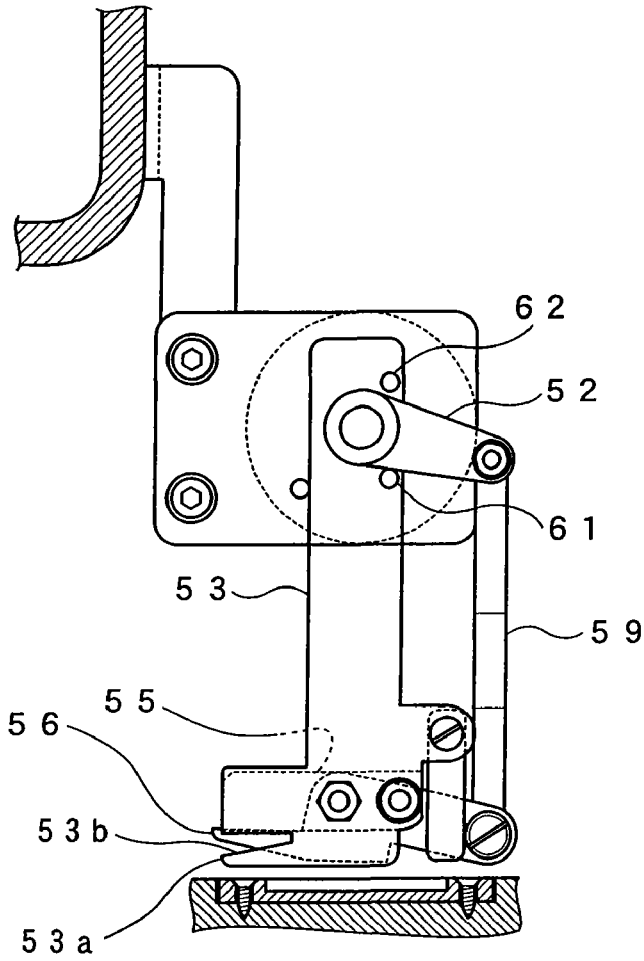
FIG. 10 is a left side view of the cutting apparatus which has cut a string material.
Figure 11:
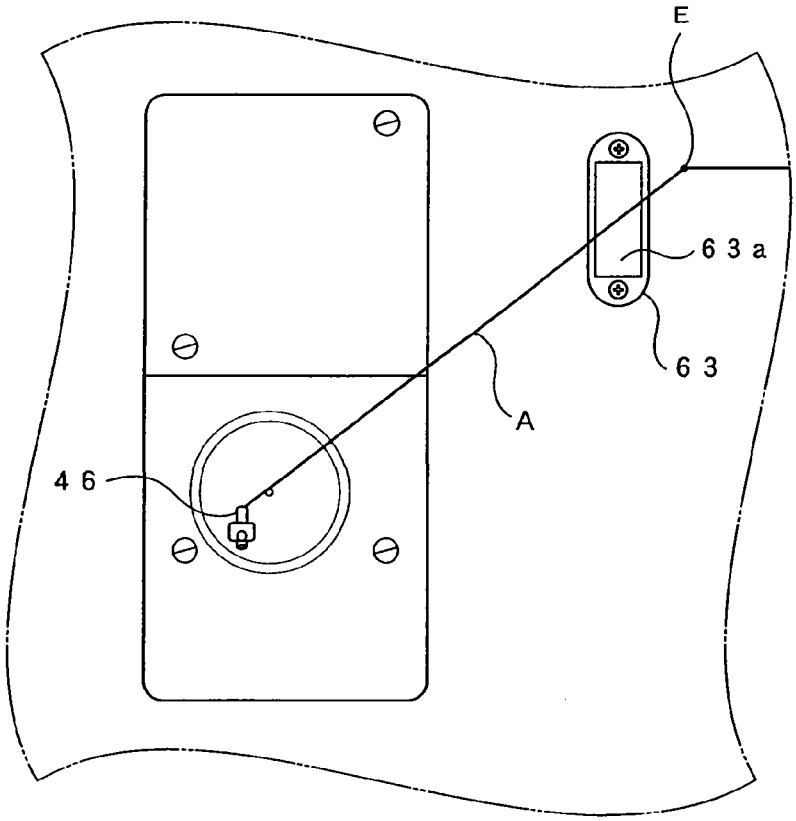
FIG. 11 is a conceptual diagram explanatory of a sewing end point to which the string material is to be moved at the end of sewing.
Figure 12:
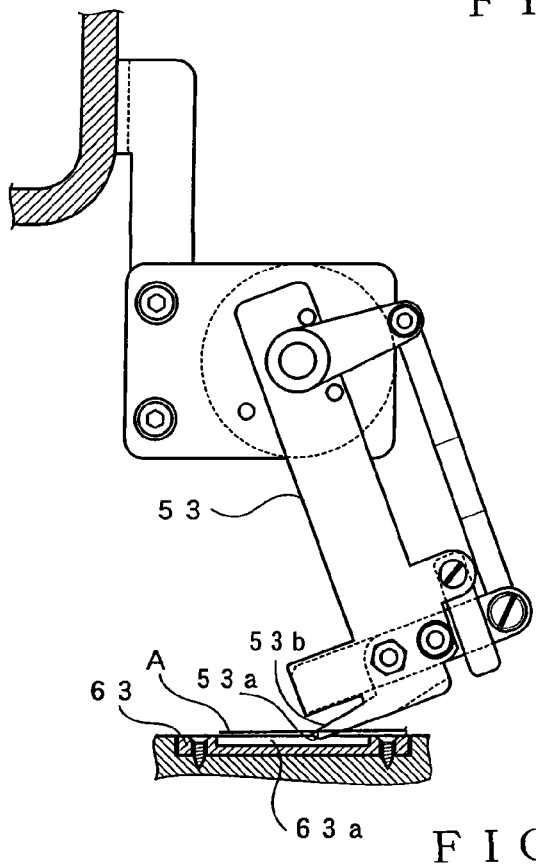
FIG. 12 is a conceptual diagram explanatory of how the string material is hooked on a hook section of a knife base.

The following paragraphs describe how the string material A is cut by the cutting apparatus S after sewing of the string material A is completed. FIG. 10 is a left side view of the cutting apparatus which has cut the string material A. FIG. 11 is a conceptual diagram explanatory of a sewing end point to which the string material A is to be moved at the end of sewing. FIG. 12 is a conceptual diagram explanatory of how the string material A is hooked on the hook section 53*a* of the knife base 53.

After sewing of the string material A onto the fabric is completed, the fabric with the string material A sewn thereon is displaced in the X- and Y-axis directions (typically, an embroidery frame holding the fabric is displaced) in such a manner that the final position on the fabric at which the string material A is finally sewn is displaced from the sewing position of the sewing needle 29 to a sewing end point E shown in FIG. 11. It goes without saying that during the movement of the fabric, the vertical movement of the needle bar 30 is suspended, and the well-known stitching by the sewing needle 29 and the not-shown rotary hook is inhibited from being performed. As the fabric is moved, the string material A is paid out from the bobbin 3 by an amount corresponding to the displaced amount of the fabric. The sewing end point E is set at such a predetermined position that part of the string material A newly paid out from the bobbin 3 goes over the groove 63*a* of the plate 63. In a state in which part of the string material A is positioned above the groove 63*a* of the plate 63, the rotary actuator 50 of the cutting apparatus S is activated to pivot the drive lever 52 in a clockwise direction (see FIG. 5). When the drive lever 52 is caused to pivot, the knife base 53 is also caused to pivot via the not-shown torsion spring together with the drive lever 52, causing the knife base 53 to pivot from the "retracted position" in which the knife base 52 lies in a horizontal position as shown in FIG. 5 to the "cutting position" in which the knife base 52 lies in a vertical position as shown in FIG. 7. When the knife base 53 is caused to pivot from the retracted position to the cutting position, the hook section 53*a* of the knife base 53 hooks thereon the string material A positioned above the groove 63*a* of the plate 63, and the hooked string material A is guided to the cutting concave section 53*b* by further pivotal movement of the knife base 53. The state of the string material A when the knife base 53 has pivoted to the cutting position as described above is as shown in FIG. 3.

Even after the knife base 53 has been caused to pivot to the cutting position (see FIG. 7), the rotary actuator 50 is continuously operated to further pivot the drive lever 52. However, since the knife base 53 is abutted against the stopper 54 at the cutting position, the pivotal movement of the knife base 53 is terminated to inhibit further pivotal movement thereof. While the pivotal movement of the knife base 53 is terminated, only the drive lever 52 is caused to further pivot, causing the pivotable knife 56 to start pivoting via the connecting plate 59. As shown in FIG. 9, the pivotable knife 56 is caused to pivot counterclockwise about the support pin 57 in response to vertical movement of the connecting plate 59 in accordance with the pivotal movement of the drive lever 52. The drive lever 52 is caused to pivot to the position indicated in FIG. 1 at which it is abutted against the lower stopper 61. Since the pivotable knife 56 is caused to pivot to the position indicated in FIG. 1 in accordance with the pivotal movement of the drive lever 52, the string material A guided to the cutting concave section 53*b* is cut in a state in which it is sandwiched between the pivotable knife 56 and the fixed knife 55. It should be noted that in cutting the string material A, an upper thread, not shown, extending from the fabric to the sewing needle 29 is cut at the same time.

After the string material A (and the upper thread) is cut, the rotary actuator 50 is rotated backward to pivot the drive lever 52 in a counterclockwise direction. Until the drive lever 52 is caused to pivot from the position indicated in FIG. 10 to the position indicated in FIG. 7, i.e., until the drive lever 52 shifts from the state in which it is held in abutment against the lower stopper 61 to the state in which it is held in abutment against the upper stopper 62, only the drive lever 52 is caused to pivot by a torsion spring, not shown. As a consequence, the pivotable knife 56 is caused to pivot to its original position. After that, the rotary actuator 50 is activated to pivot the drive lever 52 and the knife base 53 at the same time, so that the knife base 53 is caused to pivot from the cutting position indicated in FIG. 7 to the retracted position indicated in FIG. 5.

In the embodiment of the embroidering sewing machine, as described above, the knife base 53 is caused to pivot from the retracted position to the cutting position, so that the string material A is hooked on the hook section 53*a* of the knife base 53 and guided to the cutting concave section 53*b* so as to be cut. Thus, the single rotary actuator 50 can drive the cutting apparatus S to move from the retracted position to the cutting position and cause the string material A to be hooked on the hook section 53*a*. Also, the rotary actuator 50 also causes the pivotable knife 56 to pivot. Thus, the cost of the cutting apparatus S can be reduced, and the cutting apparatus S can be made compact. Further, the cutting apparatus S is disposed away from the sewing needle 29, and in cutting the string material S, the fabric is moved to newly pull out so that predetermined amount of the string material S (and the upper thread) can be newly pulled out. Thus, in sewing the string material A again, the user does not have to take the trouble to pull out the string material A of the guide 46 (and the upper thread remaining at the tip of the sewing needle 29).

Figure 13:
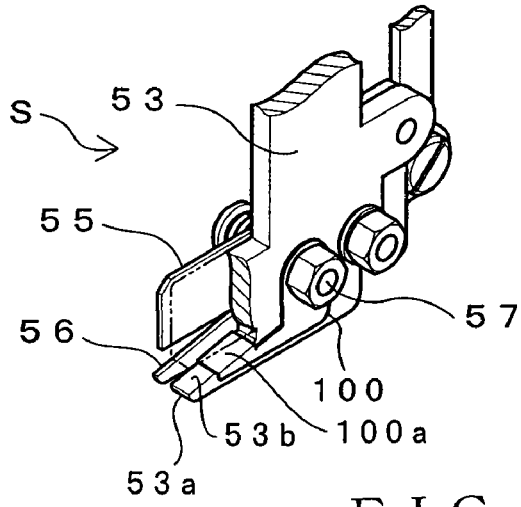
FIG. 13 is a perspective view showing a variation example of a lower part of a cutting apparatus where a knife base is provided with a retaining member.
Figure 14:
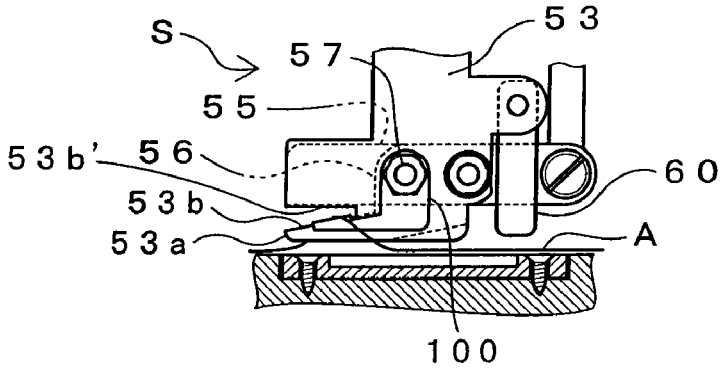
FIG. 14 is a left side view of the lower part of the cutting apparatus in accordance with the variation example shown in FIG. 13 and in a state in which the string material is hooked on the hook section.
Figure 15:
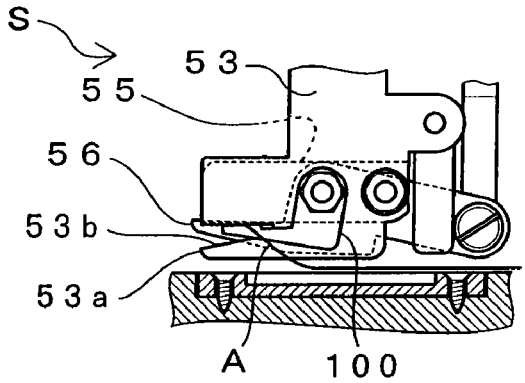
FIG. 15 is a left side view of the lower part of the cutting apparatus in accordance with the variation example shown in FIG. 13 and in a state in which the string material has been cut by pivotal movement of a pivotable knife.

In a variation example of the above described embodiment, as shown in FIGS. 13 to 15, the knife base 53 may be provided with a retaining member 100 which retains an end portion of the string material A having been cut. FIG. 13 is a perspective view showing a lower part of the cutting apparatus S in which the knife base 53 s provided with the retaining member 100. FIG. 14 is a left side view of the lower part of the cutting apparatus S in FIG. 13 where the string material A is hooked on the hook section 53*a*. FIG. 15 is a left side view of the lower part of the cutting apparatus S in FIG. 13 where the string material S has been cut by pivotal movement of the pivotable knife 56. As shown in FIG. 13, the retaining member 100 is supported by the support pin 57 in such a manner that it is pivotable together with the movable knife 56, and has a distal end portion 100*a* lies at such a position as to overlap the cutting concave section 53*b* of the knife base 53. When the movable knife 56 is caused to pivot to the cutting position, the distal end portion 100*a* of the retaining member 100 pivots upward away from a lower surface of the cutting concave section 53*b* in response to the upward pivotal movement of the movable knife 56, and therefore, the pivotable knife 56 is abutted against an upper surface 53*b*' of the cutting concave section 53*b*. The end portion of the string material A is retained between the retaining member 100 and the upper surface 53*b*' (see FIG. 15). It should be noted that, if the knife base 53 is provided with the retaining member 100, the knife base 53 may be positioned at the cutting position even after cutting of the string material A and caused to pivot to the retracted position when sewing is started again.

It should be noted that in the above described embodiment and variation, the position at which the cutting apparatus S is disposed may be set at any position insofar as a sufficient amount of the string material A enough to perform sewing again can be pulled out of the guide 46 (and the upper thread remaining at the tip of the sewing needle 29) after the string material A is cut.

The pneumatically driven rotary actuator 50 may be another type of actuator such as a pulse motor.

There may be provided a bearing member which supports a distal end portion of the rotary shaft 51 of the rotary actuator 50.

Although in the above described embodiment, the pivotable knife 56 is pivotally supported on the knife base 53, the present invention is, of course, not so limited, but the pivotable knife 56 may be configured to be slidable and may cut the string material A by sliding.

What is claimed is:

1. A cutting apparatus for cutting an elongated sewing material when sewing of the sewing material is completed in a sewing machine that includes a guide unit that guides the sewing material to a sewing position of a sewing needle, the sewing machine sewing the guided sewing material onto an object to be sewn with the sewing needle and a thread, the cutting apparatus comprising:

a main body including a hook section for hooking thereon the sewing material, the hook section being fixed relative to the main body;

a fixed blade fixed to a predetermined position of said main body and spaced away above the hook section;

a cutting blade movable relative to the fixed blade and to the hook section, the cutting blade cutting the sewing material by moving toward said fixed blade; and a drive device that moves said main body between a predetermined retracted position that does not interfere with sewing operation and a predetermined cutting position for cutting the sewing material, wherein said main body is held at the retracted position during sewing operation, and said main body is moved from the retracted position to the cutting position by said drive device to cut the sewing material, wherein said hook section hooks the sewing material while said main body is moving toward the cutting position, and wherein said cutting blade cuts the sewing material after the sewing material is hooked on said hook section and while said main body is in the predetermined cutting position.

2. A cutting apparatus as claimed in claim 1, wherein said cutting blade is configured to move in response to movement of said main body and to move toward said fixed blade in cutting the sewing material.

3. A cutting apparatus as claimed in claim 1, further comprising a retaining member provided at a predetermined location of said main body and configured to move in response to movement of said cutting blade, for retaining an end portion of the sewing material cut by said cutting blade.

4. A cutting apparatus as claimed in claim 1, wherein the cutting apparatus is disposed a predetermined distance away from the sewing position of the sewing needle.

5. A cutting apparatus as claimed in claim 1, wherein the main body pivotally moves between the predetermined retracted position and the predetermined cutting position.

6. A cutting apparatus for cutting an elongated sewing material when sewing of the sewing material is completed in a sewing machine that includes a guide unit that guides the sewing material to a sewing position of a sewing needle, the sewing machine sewing the guided sewing material onto an object to be sewn with the sewing needle and a thread, the cutting apparatus comprising:

a main body including a hook section for hooking thereon the sewing material;

a fixed blade fixed to a predetermined position of said main body;

a cutting blade that cuts the sewing material by moving toward said fixed blade; and a drive device that moves said main body between a predetermined retracted position that does not interfere with sewing operation and a predetermined cutting position for cutting the sewing material, wherein said main body is held at the retracted position during sewing operation, and said main body is moved from the retracted position to the cutting position by said drive device to cut the sewing material, wherein said hook section hooks the sewing material while said main body is moving toward the cutting position, wherein said cutting blade cuts the sewing material after the sewing material is hooked on said hook section and while said main body is in the predetermined cutting position, wherein said cutting blade is configured to move in response to movement of said main body and to move toward said fixed blade in cutting the sewing material, and wherein said drive device drives said cutting blade toward said fixed blade to cut the sewing material.

7. A cutting apparatus as claimed in claim 6, further comprising:

a connecting mechanism that connects said drive device and said cutting blade to each other;

a first regulating member that regulates movement of said main body, having moved toward the cutting position by being driven by said drive device, at a first predetermined position so as to define the cutting position; and a second regulating member that regulates movement of said connecting mechanism having been moved in response to driving operation of said drive device, wherein the second predetermined position is a position which the connecting mechanism reaches when said drive device is driven after the movement of said main body is regulated at the first predetermined position, and after the movement of said main body is regulated at the first predetermined position and before movement of said connecting mechanism is regulated at the second predetermined position, said cutting blade is caused to move toward said fixed blade of said main body by being further driven by said drive device and cut the sewing material.

8. A cutting apparatus as claimed in claim 6, further comprising a retaining member provided at a predetermined location of the main body and configured to move in response to movement of the cutting blade, for retaining an end portion of the sewing material cut by the cutting blade.

9. A cutting apparatus as claimed in claim 6, wherein the cutting apparatus is disposed a predetermined distance away from the sewing position of the sewing needle.

10. A cutting apparatus for cutting an elongated sewing material when sewing of the sewing material is completed in a sewing machine that includes a guide unit that guides the sewing material to a sewing position of a sewing needle, the sewing machine sewing the guided sewing material onto an object to be sewn with the sewing needle and a thread, the cutting apparatus comprising:

a main body including a hook section for hooking thereon the sewing material;

a fixed blade fixed to a predetermined position of said main body;

a cutting blade that cuts the sewing material by moving toward said fixed blade; and a drive device that moves said main body between a predetermined retracted position that does not interfere with sewing operation and a predetermined cutting position for cutting the sewing material, wherein said main body is held at the retracted position during sewing operation, and said main body is moved from the retracted position to the cutting position by said drive device to cut the sewing material, wherein said hook section hooks the sewing material while said main body is moving toward the cutting position, wherein said cutting blade cuts the sewing material after the sewing material is hooked on said hook section and while said main body is in the predetermined cutting position, wherein the cutting apparatus is disposed a predetermined distance away from the sewing position of the sewing needle, and wherein, when sewing of the sewing material is completed, the object to be sewn onto which the sewing material has been sewn is moved the predetermined distance toward the location at which the cutting apparatus is disposed, said drive device is driven to cause said main body to move to the cutting position and cut the sewing material.

11. A cutting method of cutting an elongated sewing material when sewing of the sewing material is completed in a sewing machine that includes a guide unit that guides the sewing material to a sewing position of a sewing needle, the sewing machine sewing the guided sewing material onto an object to be sewn with the sewing needle and a thread, the cutting method comprising the steps of:

disposing a cutting apparatus for cutting the sewing material a predetermined distance away from a sewing position of the sewing needle, wherein the cutting apparatus includes a main body including a hook section for hooking thereon the sewing material, the hook section being fixed relative to the main body, a fixed blade fixed to a predetermined position of the main body and spaced away above the hook section, and a cutting blade movable relative to the fixed blade and to the hook section;

when sewing of the sewing material is completed, moving an object to be sewn onto which the sewing material has been sewn the predetermined distance toward the position at which the cutting apparatus is disposed;

hooking the sewing material with the hook section; and cutting the sewing material by moving the cutting blade relative to the fixed blade after the hook section hooks the sewing material so that an excess amount of the sewing material, which amount corresponds to the predetermined distance, pulled out of the guide unit remains.

12. A cutting method as claimed in claim 11, wherein:

the main body is movable between a predetermined retracted position that does not interfere with sewing operation and a predetermined cutting position for cutting the sewing material, the cutting step of includes the steps of:

moving the main body from the predetermined retracted position to the predetermined cutting position to permit the hook section to hook the sewing material while the main body is moving toward the predetermined cutting position; and cutting the sewing material by moving the cutting blade toward the fixed blade after the sewing material is hooked on the hook section and while the main body is in the predetermined cutting position.

13. A cutting method as claimed in claim 12, wherein the main body pivotally moves between the predetermined retracted position and the predetermined cutting position.

* * * * *